US005271208A

United States Patent [19]

Christine et al.

[11] Patent Number: 5,271,208

[45] Date of Patent: Dec. 21, 1993

[54] METHOD AND APPARATUS FOR PICKING UP AND RESHAPING A FLUID FILLED BAG

[75] Inventors: William C. Christine, Nazareth; Scott A. Roth, Danielsville, both of Pa.

[73] Assignee: Inpaco Corporation, Worthington, Ohio

[21] Appl. No.: 934,557

[22] Filed: Aug. 24, 1992

[51] Int. Cl.[5] ..... B65B 5/04; B65B 35/16

[52] U.S. Cl. ..... 53/436; 53/173; 53/260; 53/251; 53/526

[58] Field of Search ..... 53/436, 438, 428, 526, 53/527, 523, 251, 252, 250, 249, 260, 255, 449, 173, 170

[56] References Cited

U.S. PATENT DOCUMENTS

| | | | |
|---|---|---|---|
| 2,927,412 | 3/1960 | Hayes et al. | 53/526 X |
| 3,488,915 | 1/1970 | Delestatius | 53/526 X |
| 3,811,245 | 5/1974 | Mosterd | 53/526 |
| 4,462,202 | 7/1984 | Reil | 53/526 |
| 5,195,305 | 3/1993 | Dambrosio et al. | 53/260 X |

*Primary Examiner*—James F. Coan
*Attorney, Agent, or Firm*—Hill, Steadman & Simpson

[57] ABSTRACT

An apparatus and method for loading fluid-filled bags into a box. The apparatus provides a loading arm having pairs of gripping fingers arranged on lateral sides of a bag to be loaded. The gripping fingers compress the bag into a more cubicle shape than a flat relaxed condition. The loading arms are mounted onto a horizontally rotating mechanism which moves the loading arms around a circular pathway in index fashion to four stations including a bag gripping station above a bag transporting conveyor for grabbing and lifting the bag, and a bag loading station aligned above a loaded box conveyor for depositing the bag into a box and disengaging the gripping fingers from the bag. The apparatus and method provide an advantageous loading of a fluid filled bag into a closely conforming box where the bag is adequately supported at the corners. If the bag is provided with a nozzle, the nozzle can be interfit in a relaxed state in a corner of the box.

25 Claims, 5 Drawing Sheets

METHOD AND APPARATUS FOR PICKING UP AND RESHAPING A FLUID FILLED BAG

BACKGROUND OF THE INVENTION

The present invention relates generally to form/fill-/seal processes and packaging machines. More specifically, the present invention relates to devices for transporting flexible film pouches, filled with fluid, and loading the pouches into containers.

It is known to house fluid in plastic containers created from polymeric film. These fluid filled containers can be created using form/fill/seal processes and apparatus. Advances in the development of polymeric films, plastic bag making, and packaging machines capable of form/fill/seal processes have brought about the development of a fluid product packaging system referred to as a "bag-in-box."

The "bag-in-box" packaging system has proven to be especially efficient and economical for pouches, bags, or sacks filled with products of a fluidic nature. The fluid is typically withdrawn from the bag by means of a tap, a metering device, pump, pour spout or the like.

In systems employed today for bag-in-box packaging, whether they be with pre-manufactured bags or produced in a form/fill/seal process, a pillow-shaped plastic film bag is filled with fluid, closed, and then discharged onto a conveyor or chute. The next operation requires that the bag be loaded into its secondary package (box) for palletizing or loading into a tertiary package or "shipper" for palletizing.

Significant dimensional changes must take place in order for a fluid filled bag to assume a relaxed position in a box. There are a number of devices which are utilized in the bag-in-box industry today which depend upon either a substantial manual effort, vacuum pick-ups, or require the dropping of the bags into an elevated chute where the velocity of the bag upon entering the box causes some reshaping of the bag to the box. These type of devices, as stated, either require manual assistance to locate the bag accurately or the box must be substantially oversized to allow for the loading. These systems are not entirely satisfactory from a process and/or economic standpoint.

There is therefore a need for an apparatus and process for transporting and loading fluid filled bag into containers (boxes).

SUMMARY OF THE INVENTION

The present invention relates to the loading of a filled bag into a secondary packaging unit or box. Pursuant to the present invention a unique method is provided that is an efficient, non-stressful method of reshaping the typically pillow-shaped fluid filled bag into the rectilinear shape of the box.

The invention, in an embodiment, can be used advantageously for boxing three liter fluid filled bags. In a typical three liter bag the bag would have empty dimensions averaging approximately 10 inches by 13 inches (254×330 mm) in a horizontal profile laying flat. The total capacity of this bag would be approximately four liters if filled to bursting. The extra capacity provided for in the bag allows the bag to be reshaped and permits the bag to relax into the rectangular shape of the box. There would normally be a small amount of gas present in the package; e.g. 60 to 80 cc of either air or, in the case of oxygen sensitive products, an inert gas such as nitrogen.

Therefore, the bag to be boxed, when laying flat, would exhibit the dimensions 10 inches wide by 13 inches long by approximately 2 inches tall (254×360×50 mm). Typically, a box into which this bag would be placed for shipment would be 7 inches wide by 9 inches long by 3.5 inches deep (178×230×90 mm).

In the present invention, a loading arm for placing a fluid filled bag into a box is provided which comprises a supporting shaft arranged to be lowered toward a bag to be loaded; a housing mounted to an end of the supporting shaft; finger means supported by the housing and arranged to be at least partially positionable on opposite sides of the bag to be loaded; and means for selectively displacing the finger means toward or away from each other.

Pursuant to the present invention, a pouch loader is provided having, in an embodiment, two opposing suspension bars or travelling blocks each having two arcuately formed, nearly perpendicular blunt-ended fingers mounted facing the bag spaced apart along each respective suspension bar. The pouch loader utilizes a supporting shaft that can be lowered toward the bag to be loaded, a housing mounted to an end of the supporting shaft and facing the bag to be loaded; the finger pairs are slidably supported within the housing and positionable on opposite sides of the bag to be loaded. A mechanism is provided for selectively displacing the fingers toward or away from each other.

With the finger size and spacing properly selected, the, for example, 10 inch by 13 inch by 2 inch filled bag is distorted to a width and length of 6.5 inch by 9 inch. In addition, the corners are caused to be folded inward in a safe attitude, and a spout provided on the bag can be positioned into a corner position in the box.

A wide range of bag sizes with correspondingly appropriate box dimensions can be handled in the same manner as the above-described three liter system.

Multiple pouch loaders can be provided in a pouch loading apparatus. Each pouch loader can be successively presented to a pick-up station and a loading station to provide high speed automatic bag-in-box loading. In practice, four or more pouch loaders can be provided on a rotating indexing platform.

In an embodiment, a multiple pouch loader station is advantageously assembled using four pouch loaders vertically slidably mounted to a platform. The platform is index rotatable by an index motor. Four stations are defined by: the indexing motor; a bag engaging and lifting station; an intermediate station; an arm lowering and bag loading into box station; and a second intermediate station. These stations are defined at quarter points of the circle traversed by the rotating platform. A circular track is arranged above the platform and each pouch loader provides a roller which rides in the track. Thus, the circular track supports the pouch loaders during their travel. Mounted above the circular track is a structural platform which holds a drive train for imparting movements to the pouch loaders. A first mechanism raises or lowers the pouch loader at the first and third station for bag grabbing o bag unloading respectively. The second mechanism rotates an activation shaft of each pouch loader to cause the fingers to either grip or release their grip from the bag at the first station and third station respectively. The drive train for actuating these first and second mechanisms is advantageously driven by a single motor.

It is an advantage of the invention that while picking up and depositing the bag, any device such as a tap or pump mounted on the bag is carefully positioned so that it presents itself in the correct relative position in the box in a non-stressful manner.

The weakest point of a liquid filled pouch is at the intersection of the vertical and horizontal seams, or corners. It is an additional advantage of the invention to fold these corners so that there is no hydraulic stress confronting these corners during shipping or handling.

Still further is an advantage of the invention that the device is simple, fast, accurate, and energy efficient.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
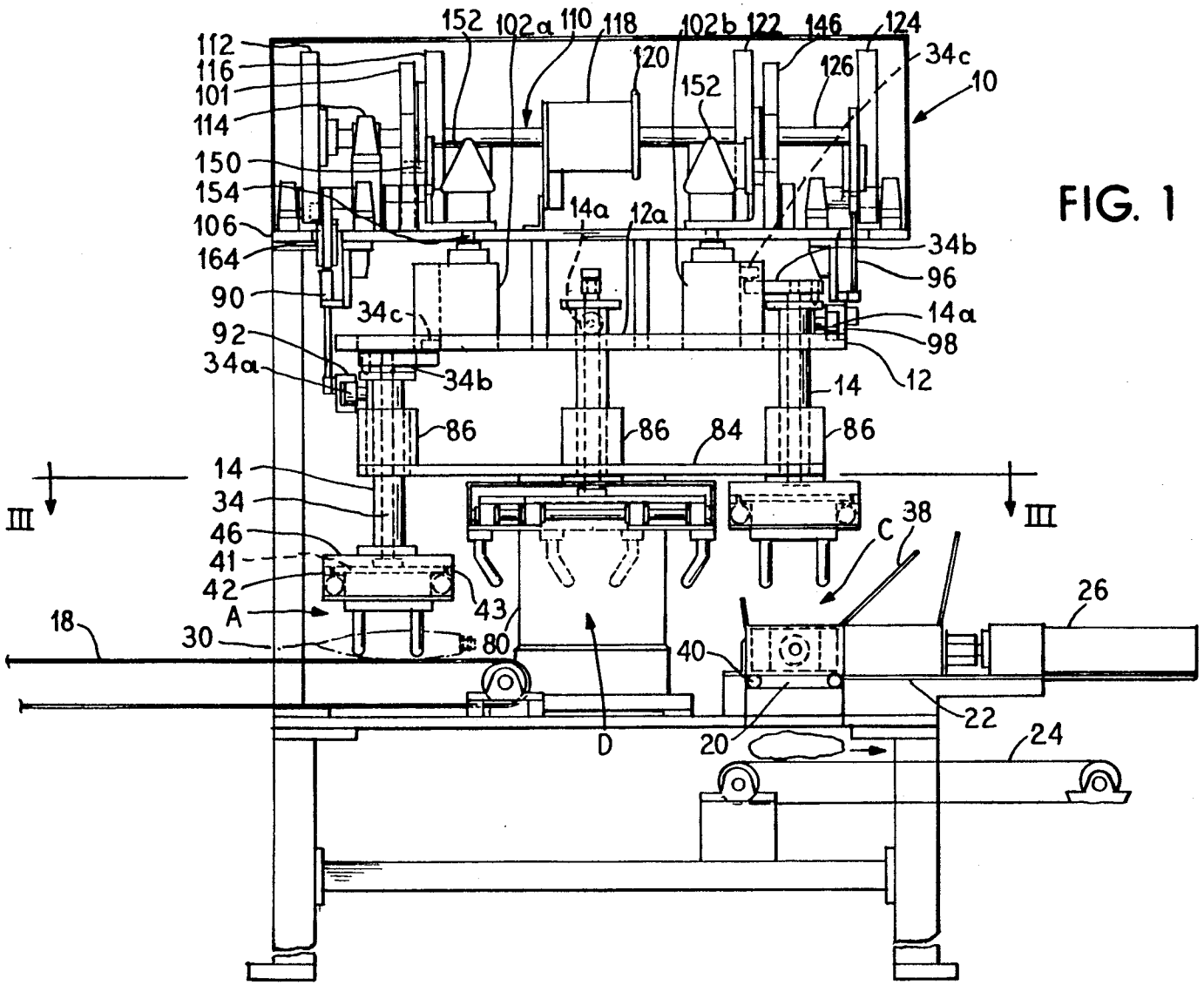
FIG. 1 is a front elevational view of an embodiment of a bag-in-box loader of the present invention.
Figure 2:
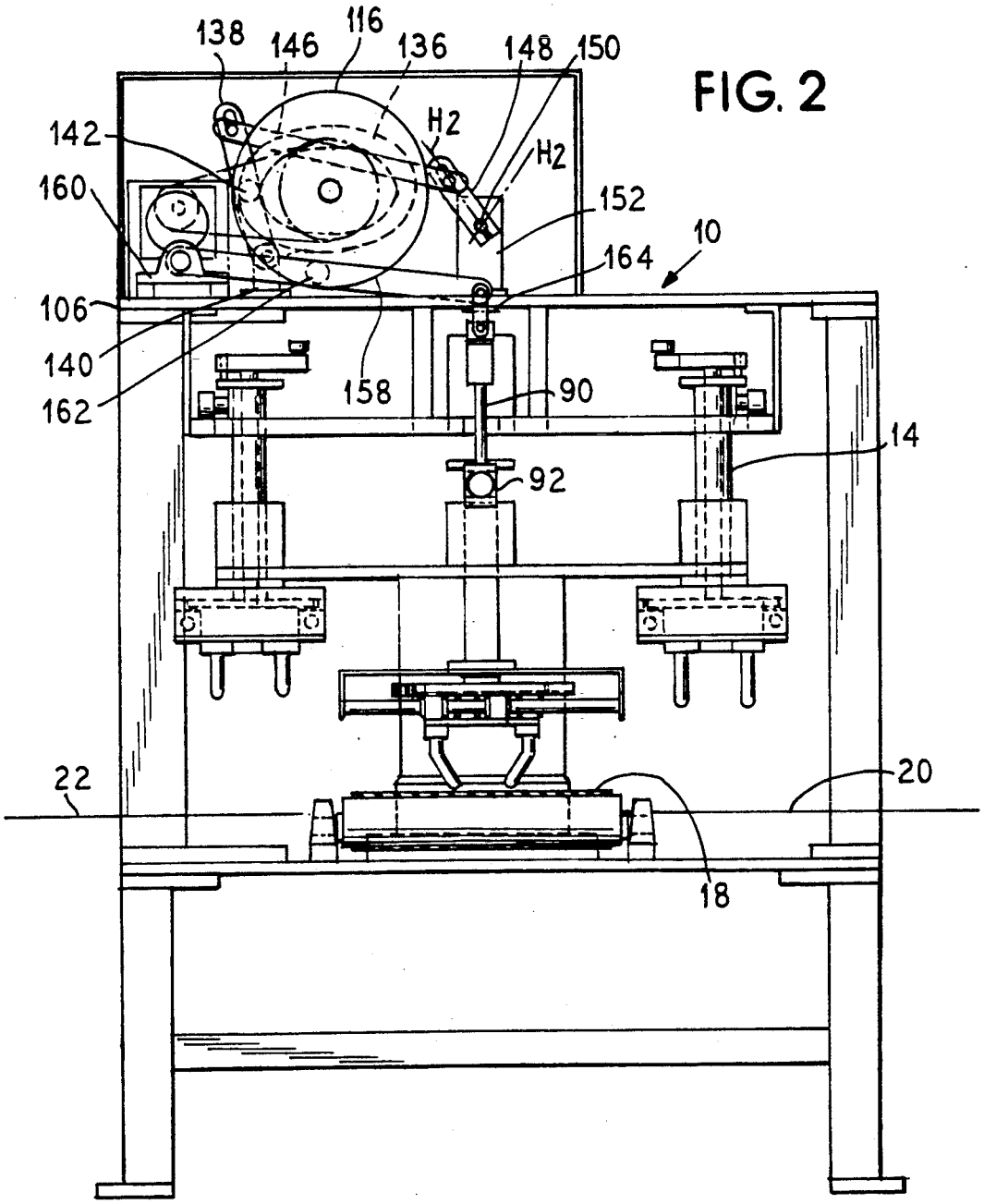
FIG. 2 is a side elevational view of the loader shown in FIG. 1.

The present invention provides a device for loading fluid filled pouches in boxes or containers. Referring to the figures, FIG. 1 illustrates a preferred embodiment of the bag-in-box loading machine 10. The machine 10 comprises an overhead circular track 12 which mounts a plurality of bag engaging arms 14 which extend downwardly. Below the track 12 and arranged horizontally is a bag-in-feed conveyor 18 and a loaded box outflow conveyor 20. An empty box inflow conveyor 22 is provided as well as a bag recycle conveyor 24. Arranged perpendicularly to the empty box in-flow conveyor 22 is a box pusher 26 which, when activated, translates an empty box beneath the track 12 and in line with the loaded box outflow conveyor 20 as will be described hereinafter.

In the preferred embodiment illustrated, below the track 12 are arranged four stations arranged at quarter points around a circular pathway. A first station A is oriented directly above the bag-in-feed conveyor 18. A second station B is shown more clearly in FIG. 3 at 90° from station A. A third station C is arranged directly above the loaded box outflow conveyor 20, 180° from station A. A fourth station D is located 90° from station C.

At station A, one of the arms 14 is lowered closely to a bag 30 which has moved along the conveyor 18 to a position beneath the arm 14. The arm provides four fingers 32, of which two fingers align on each side of the bag 30. The arm 14 comprises an input shaft 34 which, by rotating, brings opposing finger pairs together to squeeze the bag therebetween. This arrangement is more clearly discussed hereinafter. Once gripped, the bag deforms with the corners folding inward and the bag attaining an increased height and reduced width and length. The arm 14 is then raised lifting the bag into the air. The arm rotates 90° at this point and the bag is transported to station B. Another arm 14 is thereby rotated into the station A for picking another bag.

The arm rotates 90° further and the lifted bag 30 is now positioned at station C. At station C, the arm 14 descends downwardly transporting the bag into an opened box 38. The box has been previously transported along the empty box inflow conveyor 22 and translated laterally by the box pusher 26 into position beneath the arm 14 at station C. Because of the bags folded and distorted condition, it easily fits into the box as will be more fully described with respect to FIGS. 7 and 8.

If for any reason a box is not in position during operation, the apparatus provides for this error. The platform at station C for holding the box is designed to support the stiff bottom of a box, but to pass therethrough the flexible structure of a bag. For example, as shown in FIG. 1, two bars 40 are provided for support wherein the box can span these bars, but a bag would fall therethrough. Once passing therethrough, the bag lands upon a recycle conveyor 24 for transport to a means for reloading the filled bag onto the bag-in-feed conveyor 18.

Figure 3:
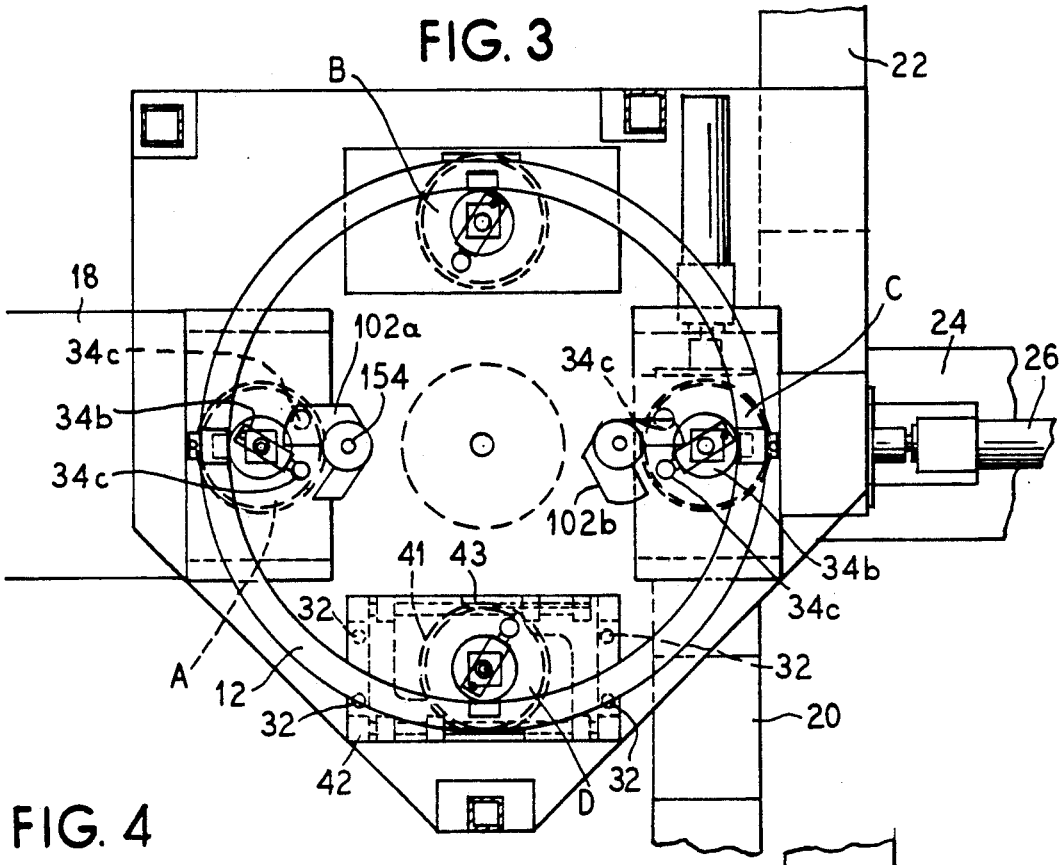
FIG. 3 is a sectional view taken generally along line III—III of FIG. 1.

FIG. 3 shows the non-linear relationship between the empty box inflow conveyor 22 and the loaded box outflow conveyor 20 and the box pusher 26.

FIG. 1 and FIG. 3 illustrate an embodiment of the finger gripping mechanism. A pinion 41 is mounted axially at the distal end of the shaft 34 and meshes with a first rack 42 and meshes with a second rack 43. The first rack 42 is connected to a first traveling block **42*a* and the second rack 43 is connected to a second traveling block 43*a*. Each traveling block mounts two fingers 32** thereon. Rotation of the shaft and pinion clockwise or counterclockwise either closes the pairs of fingers together or separates the pairs of fingers by translating the racks in opposite directions and either drawing the traveling blocks together or separating the traveling blocks.

Figure 5:
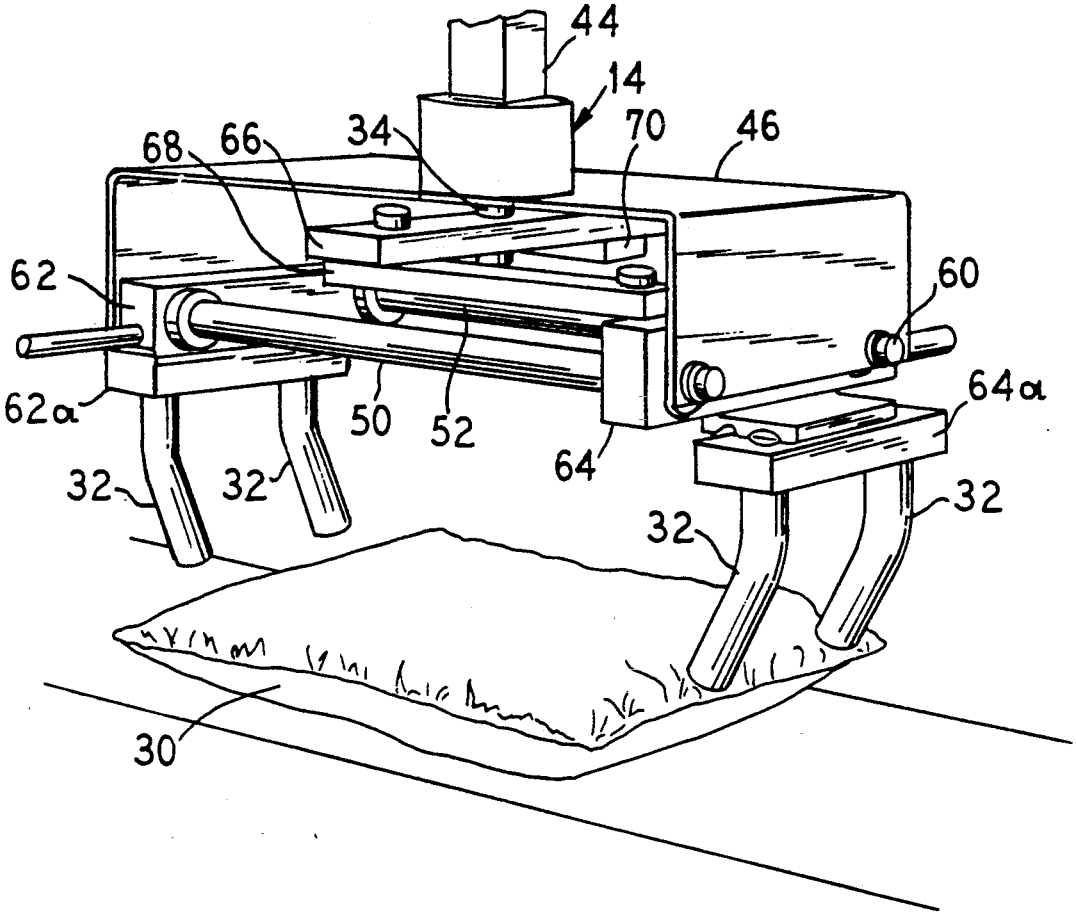
FIG. 5 is a partial perspective view of a loader open and ready for engaging a bag.

FIG. 5 illustrates another configuration of the arm 14 in greater detail. The arm provides a support shaft 44 which mounts at a lower end thereof a head portion or housing 46 in the form of a U-shaped channel. Mounted so as to span the U-shaped channel 46 are two tubular guideways 50, 52. The guideways are connected by a clamp to the housing 46 via washers and nuts 60.

Riding along the parallel tubular guideways 50, 52 are opposing traveling blocks 62, 64. Extending downward from these traveling blocks, 62, 64 are the fingers 32. By moving the traveling blocks 62, 64 toward each other, the fingers 32 grip and distort the bag 30.

The fingers engage the bag along the centerline of the two inch high edge. The "slack fill" of the bag allows the bag to reshape itself around the fingers, causing compensating reactions elsewhere in the bag. The actual compensation that results is that the corners of the bag fold in toward the respective adjacent finger as the finger advances.

As the finger pressure increases, most of the fluid is evacuated from the folded corners into the central bag cavity. As the fingers close to a predetermined position (length and width), it will be found that, in for example a three liter bag, the width dimension has now become 6.5 inches while the length becomes 9 inches. The bag can now be lowered partially into the box where the pressure of the fingers will be released and the fingers are withdrawn upward and outward. In practice, the length of the finger, the number of the fingers, and their location (relative to the bag width) can be selected so that, as in the case of the three liter bag, the bag can be slipped into position in the box, with the corners folded into a safe attitude, and the spout precisely located as to its service port in the box.

To effectuate the moving together of the travelling blocks 62, 64 or conversely the separating of the travelling blocks 62, 64, a lever arrangement is provided. The input shaft 34 is connected for rotation with a cross lever 66. The cross lever 66 is pin connected to a first tie rod 68 itself pin connected to the travelling block 64. At an opposite end of the cross lever 66 is mounted a second tie rod 70 which is pin connected to the first travelling block 62. Thus, by rotation of the input shaft 34, the cross lever rotates accordingly and either draws the travelling block 62, 64 together or forces the travelling blocks 62, 64 apart. The travelling blocks 62, 64 can be provided with sub-blocks **62*a*, 64*a* which slidably adjust with the travelling blocks 62, 64 to adjust the distance between the opposed pair of fingers 32** depending on the bag size.

Figure 7:
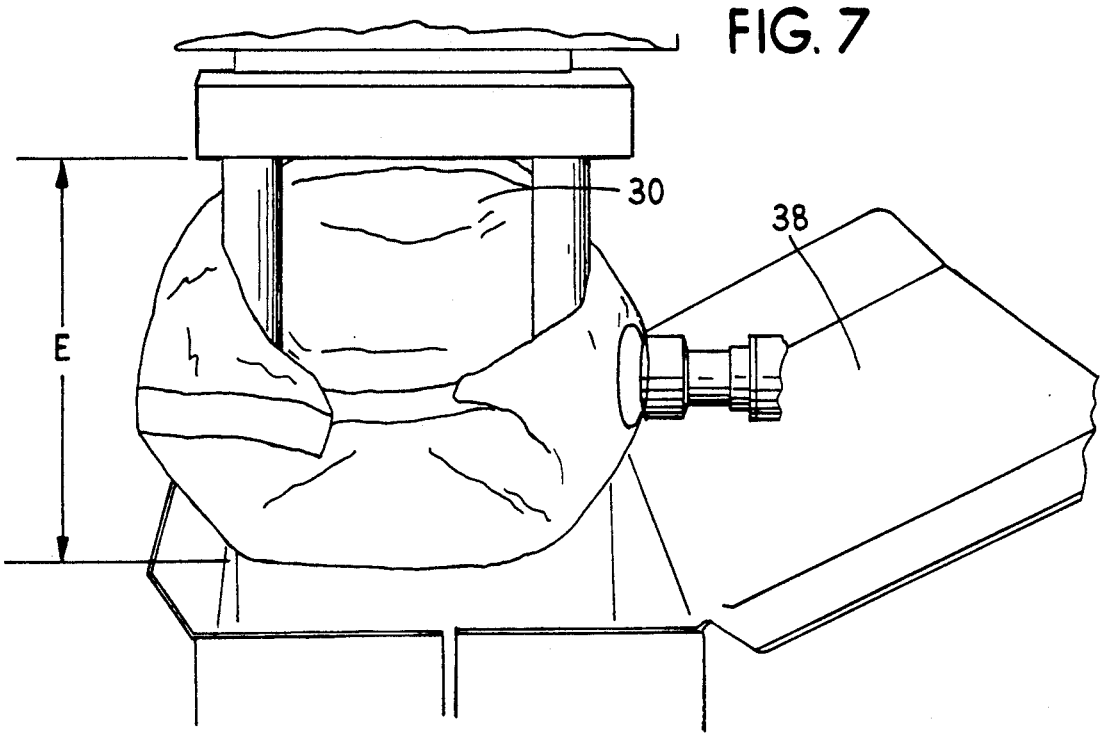
FIG. 7 shows the loader of FIG. 5 positioned over an open box for loading the bag into the box.
Figure 8:
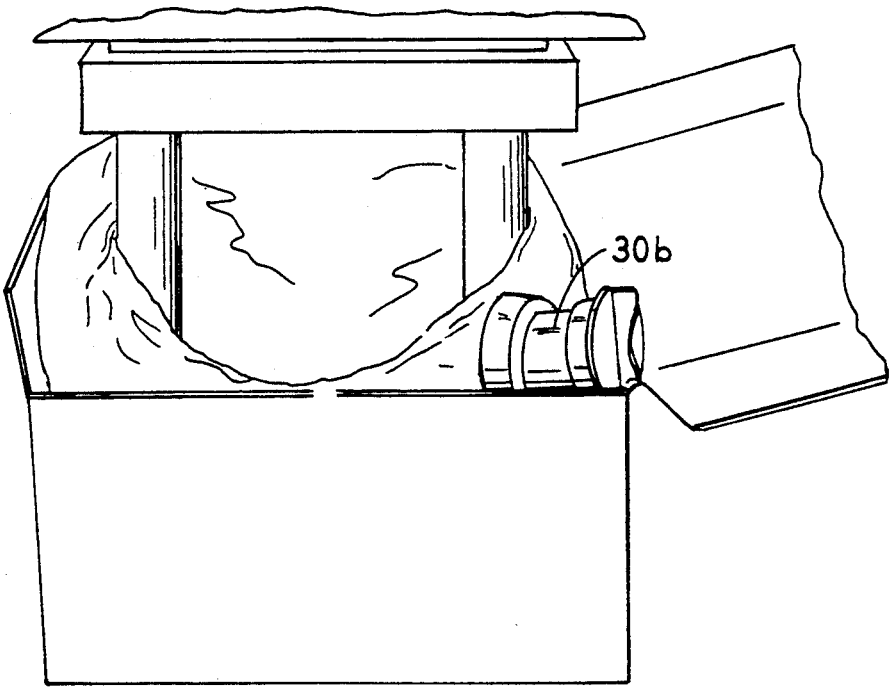
FIG. 8 shows the bag of FIG. 7 lowered into and conforming with the box.

FIG. 7 shows a gripped bag at station C being deposited into an open box 38. In the gripped condition the corners **30*a* of the bag are folded inward and the bag 30 has attained a higher dimension E than in the relaxed state. In this distorted condition the bag has attained a more cubicle shape rather than a flat relaxed shape and fits more readily into the box. As shown in FIG. 8 the bag is interfit into the box with a nozzle portion 30*b*** of the bag comfortably interfit into a corner of the box in a relaxed state.

Figure 6:
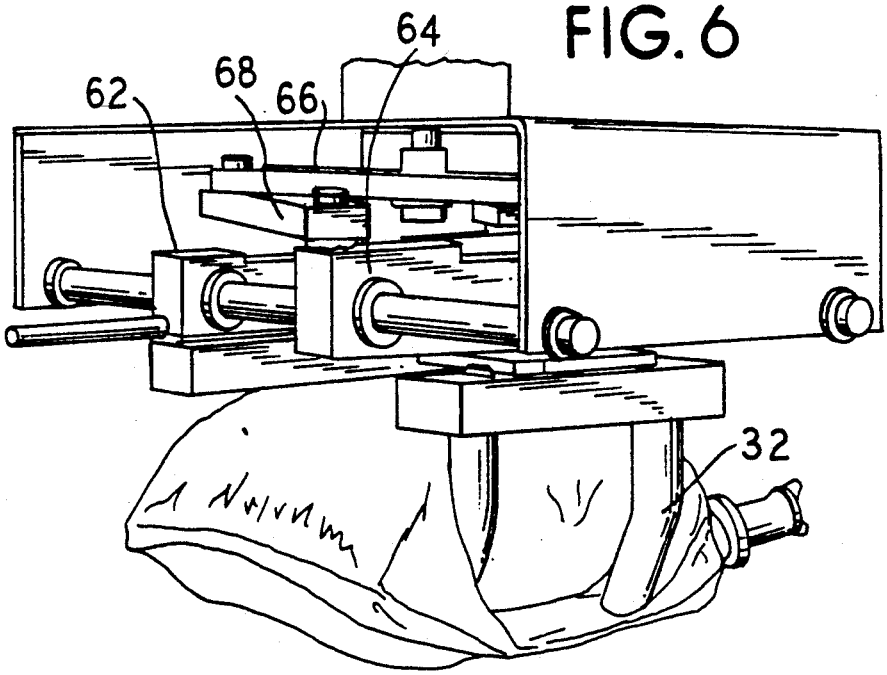
FIG. 6 shows the loader of FIG. 5 after engagement of the bag.

As shown in FIG. 5 the fingers are advantageously shaped slight arcuate or angled inward to grip the bag. To eliminate stress to the polymeric film of the bag, the tips of the fingers resemble the shape of human fingertips. A 0.75" diameter finger can be used. A 13 inch by 10 inch bag for a 3 liter liquid volume attains the cubicle distortion as shown in FIG. 6 of approximately 9"×6.5" which will slip into a 9"×7" box typical for a 3 liter volume bag.

Referring back to FIGS. 1–4, the operation of the bag-in-box loading machine 10 will now be more fully described.

An index drive 80 is provided that is connected to a rotating platform 84 thereabove. The index drive can be a COMPUMOTOR index drive, four station stepper motor DR1400H or similar. The platform 84 mounts thereabove at quarter points for sleeves 86. The sleeves 86 guide the respective arms 14 for vertical movement therethrough.

The track 12 provides an upper surface **12*a* whereupon a roller 14*a* mounted to each arm 14 can roll. The roller 14*a* rolls from station A to station C and from station C to station A with the arm 14 in an upward retracted position. At station A, a lowering mechanism 90 having a C-shaped receiver 92 lowers and supports the arm 14 into the bag grab position. This lowering mechanism 90 thereafter raises the arm 14 to place the roller 14*a* on the track 12 so that the arm 14 can be supported on the carousel 12** and revolved to station B and beyond.

At station C, a lowering mechanism 96 similar in design to the lowering mechanism 90, having a C-shaped receiving member 98 receives the roller **14*a* of the arm 14 in the upward retracted position and lowers the arm 14 downward to the bag dropping position. The lowering mechanism 96 thereupon is raised to place the roller 14*a* back on the carousel 12 for eventual rotation to position D in the upward retracted position as shown in FIG. 1. At station C when the arm 14 is lowered, the mechanism operates similarly to the arm 14 shown lowered in FIG. 1** at station A. The movement of the fingers are reversed, however, so that the bag is released in the lowered position rather than grabbed.

The raising and lowering of the arms 14 and the turning of the input shaft 34 will now be described. The input shaft 34 proceeds up through the arm 14 and is connected to a lever **34*b* having an engaging roller 34*c* at an end thereof. At both station A and station C, the roller 34*c* is capturable by a generally V-shaped actuator 102*a*, 102*b*. The actuators 102*a*, 102*b* rotate about a vertical axis. Rotation of the actuators 102*a*, 102*b* rotates the lever 34*b* via the roller 34*c* which, in turn, rotates the input shaft 34**.

Figure 4:
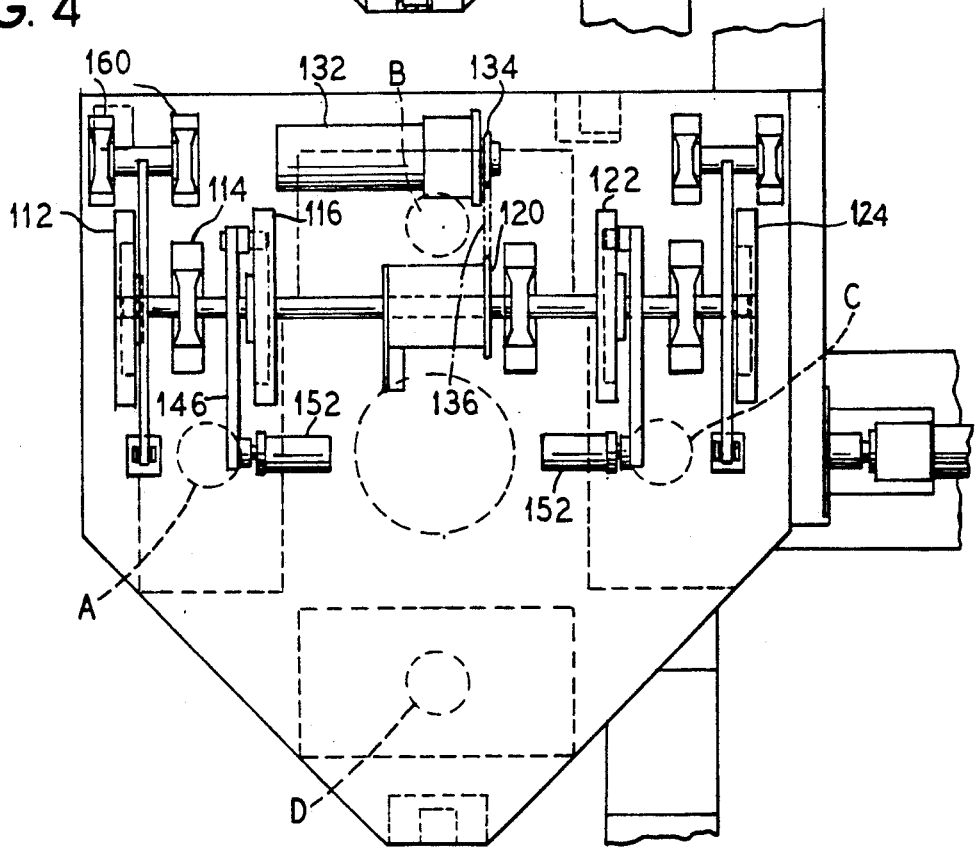
FIG. 4 is a top plan view of the loader of FIG. 1.

Mounted above the actuators **102*a*, 102*b* is a platform 106 upon which is mounted two synchronized components for imparting the up and down motion to the lowering mechanisms 90, 96 and the turning of the actuators 102*a*, 102*b*. Mounted to the platform 106 is a drive train 110 which comprises the following components arranged in axial fashion: a first cam plate 112; a support bearing 114; a second cam plate 116; a spring clutch 118; a chain sprocket 120; a third cam plate 122; and a fourth cam plate 124. Not all of the support bearings are illustrated in FIG. 1 for clarity. The plan view of FIG. 4 illustrates additional support bearings. A drive shaft 126** connects these components axially.

As illustrated in FIG. 4, a motor and speed reducer 132 has a sprocket 134 mounted at an end thereof. A drive chain 136 surrounds the sprocket 134 and the drive sprocket 120. Thus, the drive shaft 126 is rotationally axially driven by the sprocket 120.

The operation of the actuator **102*a*, 102*b* is as follows. The cam plate 116 provides an elliptical groove 136 on a face thereof. A first lever 138 is provided and pin connected to a gusset 140 itself anchored to the platform 106. Near midpoint of the first lever 138 is a cam follower peg 142 which rides in the elliptical channel 136 of the cam plate 116**.

At a distal end of the first lever 138 is connected a second lever 146 via a pin and slot connection. At an opposite end of the second lever 146, a third lever 148 is connected with a second pin and slot connection. The third lever 148 is itself rotationally fixedly connected to an input shaft 150 of a right angle gear actuator 152. Thus, upon rotation of the cam plate 116, the cam follower peg 142 is caused by the elliptical pathway 136 to oscillate horizontally. This horizontal oscillation is transmitted through the first, second and third levers to cause a pivoting of the third lever 148 between an angular position $H_1$ and a second angular position $H_2$. This angular movement of the input shaft 150 is changed to a turning about the vertical axis of an output shaft 154 of the right angle actuator 152. The output shaft 154 is connected to a respective actuator **102*a*, 102*b*** which in turn pivots accordingly.

The operation of the lowering mechanisms 90, 96 is as follows. A lift lever 158 is pinned to a gusset plate 160 itself anchored to the platform 106. A cam follower peg 162 is mounted near mid point of the length of the lift lever 158. The cam follower peg is carried in a second elliptical path (not shown for clarity) formed on a side of the first cam plate 112 which is arranged having an elongate axis arranged vertically as opposed to the horizontal orientation of groove 136. Therefore, the cam follower peg 162 oscillates vertically.

Vertical oscillation of the cam follower plate 162 causes a raising and lowering of a pinned connector 164 mounted at an end of the lift lever 158 and also mounted to a top of the lowering mechanism 90, 96 respectively. Therefore, vertical oscillation of the cam follower plate 162 causes a pivoting about the pinned connection 160 and a vertical reciprocation of the lifting mechanism 90, 96 respectively. The operation of the actuator 102*b* and the lowering mechanism 96 are similar to the operation of the actuator 102*a* and the lowering mechanism 90 so a separate description of those components is not warranted.

FIG. 3 illustrates the position of the roller 34*c* as shifting from the solid line figure to the dashed line figure by the movement of the actuator 102*a* at station A. This movement causes the shaft 34 to rotate and to grip the bag with the fingers 32. At station C the actuator 102*b* has rotated the lever 34*b* and roller 34*c* from the dashed line position to the solid line position which would cause an opening of the fingers 32 for depositing the bag in the box.

As so far described, the various movements of the drive train 110 are independent of the rotation of the platform 84 by the stepping motor 86. However, the two systems should be synchronized and such can be accomplished by a control system known to those skilled in the art.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

I claim as my invention:

1. A loading arm for placing a fluid-filled bag into a box comprising:
   - a supporting shaft arranged to be lowered toward a bag to be loaded;
   - a housing mounted to an end of said supporting shaft;
   - finger means supported by said housing and arranged to be at least partially positionable on opposite sides of said bag to be loaded; and
   - means for selectively displacing said finger means toward or away from each other.

2. The loading arm according to claim 1, wherein said finger means comprises two first fingers arranged laterally spaced apart and two second fingers arranged laterally spaced apart, said first fingers and said second fingers slidable toward and away from each other.

3. The loading arm according to claim 1, wherein said finger means comprises:
   - two first fingers arranged laterally spaced apart and mounted to a first travelling block;
   - two second fingers arranged laterally spaced apart and mounted to a second travelling block; and
   - said means for moving said finger means together or apart comprises an input shaft mounted coaxially within said supporting shaft and a means for converting axial torque on said input shaft into translational force driving the first and second travelling blocks together or apart, said means for converting connected to said input shaft and to said travelling blocks.

4. The loading arm arrangement according to claim 3, wherein said travelling blocks are mounted slidably within said housing on a rail.

5. A bag into box loading apparatus comprising:
   - a loading arm extending vertically downward, said loading arm having finger means for selectively gripping and holding a fluid filled bag to be loaded into a box;
   - a means for indexing said loading arm from a first staging area to a second staging area;
   - a means for loading fluid filled bags into said first staging area to be gripped and picked up by said loading arm;
   - a means for loading open boxes into said second staging area for said loading arm to deposit said bag into said open box.

6. The apparatus according to claim 5, wherein said means for loading said fluid filled bags comprises a conveyor belt passing into said first staging area.

7. The apparatus according to claim 5, wherein said means for loading open boxes comprises a conveyor belt passing adjacent to said second staging area, and a box pusher means for translating said box into said second staging area.

8. The apparatus according to claim 5 further comprising a bag transport means arranged beneath said second staging area and wherein said second staging area comprises a supporting means for supporting said box for loading, said supporting means permitting a fluid-filled bag to pass therethrough onto said bag transport means.

9. The apparatus according to claim 5 further comprising a second loading arm extending vertically downward and spaced apart from said loading arm, said second loading arm to be in said second staging area when said loading arm is in said first staging area, said second loading arm having finger means for gripping and holding a fluid filled bag to be loaded into a box.

10. The apparatus according to claim 5 further comprising a second loading arm extending vertically downward and having finger means for gripping and holding a fluid filled bag to be loaded into a box; and
   - said apparatus further comprises means for supporting said loading arm and said second loading arm during travel from said first staging area to said second staging area; and
   - means for lowering said loading arm and said second loading arm to grip a fluid filled bag and for retracting the thus gripped bag vertically; and
   - means for lowering said loading arm and said second loading arm to deposit the gripped fluid filled bag into a box.

11. The apparatus according to claim 5, further comprising a substantially circular track and a second loading arm, said loading arm and said second loading arm comprise rollers, said rollers are arranged to be supported and roll on said track for movement of said loading arm and said second loading arm to and from said first and second staging areas.

12. The apparatus according to claim 5, wherein said finger means comprises:
   - two first fingers arranged laterally spaced apart and mounted to a first travelling block;

two second fingers arranged laterally spaced apart and mounted to a second travelling block; and said means for moving said finger means together or apart comprises an input shaft and a means for converting axial torque on said input shaft into translational force driving the first and second travelling blocks together or apart, said means for converting connected to said input shaft and to said travelling blocks, and a means for selectively applying an axial torque to s id input shaft.

13. The apparatus according to claim 5, comprising a track from said first and second staging areas and said loading arm comprises a roller supported by said track; and said apparatus further comprises a lowering and raising mechanism which receives said roller at said first and second staging areas respectively and is fashioned to reciprocate to lower and raise said loading arm accordingly.

14. The apparatus according to claim 5, wherein said finger means comprises:

two first fingers arranged laterally spaced apart and mounted to a first travelling block;

two second fingers arranged laterally spaced apart and mounted to a second travelling block; and said means for moving said finger means together or apart comprises an input shaft and a means for converting axial torque on said input shaft into translational force driving the first and second travelling blocks together or apart, said means for converting connected to said input shaft and to said travelling blocks; and said input shaft comprises a lever mounted at a top end thereof; and said apparatus further comprises an actuator means for selectively applying a force to said lever.

15. The apparatus according to claim 14 further comprising means for raising and lowering said loading arm, said means for actuating and said means for raising and lowering said loading arm comprising cam plates coaxially mounted on a drive shaft and rotated by a motor.

16. The apparatus according to claim 5, wherein said finger means comprises:

two first fingers arranged laterally spaced apart and mounted to a first travelling block;

two second fingers arranged laterally spaced apart and mounted to a second travelling block; and said means for moving said finger means together or apart comprises an input shaft and a means for converting axial torque on said input shaft into translational force driving the first and second travelling blocks together or apart, said means for converting connected to said input shaft and to said travelling blocks, and means for selectively applying an axial torque to said input shaft; and said first finger and said second fingers are concave toward said bag to be loaded.

17. A loading arm for placing a fluid-filled bag into a box comprising:

a support arranged to be lowered to the bag to be loaded;

a housing mounted on an end of said support and facing said bag to be loaded;

a first travelling block and a second travelling block, arranged spaced apart and slidable away and toward each other within said housing;

a first finger mounted to said first travelling block and a second finger mounted to said second travelling block, said fingers and said travelling blocks adapted for said first finger and said second finger to be arranged on opposite sides of a bag to be loaded; and a first rack connected to said first travelling block and arranged longitudinally within said housing;

an input shaft having a first end penetrating into said housing and adapted to receive a torque signal; and a pinion mounted to said first end of said input shaft and engaged with said first rack.

18. The loading arm according to claim 17, further comprising a third finger mounted to said first travelling block and spaced apart from said first finger and a fourth finger mounted to said second travelling block and spaced apart from said second finger and said first finger, second finger, third finger and fourth finger are formed concavely toward said bag to be loaded.

19. The loading arm arrangement according to claim 18, wherein said travelling blocks are mounted slidably within said housing on a rail.

20. A method for loading a fluid filled bag into a box comprising the following steps:

delivering a fluid filled bag to a first staging area;

providing a loading arm vertically movable and horizontally movable;

providing on the loading arm gripping means openable to be placed on opposite lateral sides of the fluid filled bag and which is actuatable to grip the bag;

horizontally moving said loading arm into said first staging area;

lowering said loading arm downward to place said gripping means on opposite lateral sides of said fluid filled bag;

actuating said gripping means to grip said fluid filled bag;

horizontally moving said loading arm with said fluid filled bag to a second staging area;

delivering into said second staging area a box having an open top; and lowering said loading arm toward said box and reverse actuating said gripping means to separate and release said fluid filled bag.

21. The method according to claim 20 comprising the further step of providing a plurality of loading arms mounted onto a rotating carousel, said carousel rotating individual loading arms from said first staging area to said second staging area in index fashion.

22. The method according to claim 20 comprising the further step of transporting a plurality of boxes intermittently to a prestaging area adjacent said second staging area and pushing a box to be loaded from said prestaging area into said second staging area.

23. The method according to claim 20 comprising the further step of during gripping of said fluid filled bag, distorting the fluid filled bag, achieving a smaller horizontal profile for the fluid filled bag.

24. The method according to claim 23 comprising the further step of while distorting said fluid filled bag, folding corners of said fluid filled bag inwardly on opposite lateral sides.

25. The method according to claim 24 comprising the further step of providing a spout on said fluid filled bag and during distorting, arranging said spout to fold into a position to tuck into a corner of the box.

* * * * *